US005439364A

United States Patent [19]

Gerking et al.

[11] Patent Number: 5,439,364

[45] Date of Patent: Aug. 8, 1995

[54] APPARATUS FOR DELIVERING AND DEPOSITING CONTINUOUS FILAMENTS BY MEANS OF AERODYNAMIC FORCES

[75] Inventors: Lüder Gerking; Friedrich Weger, both of Berlin, Germany

[73] Assignee: Karl Fischer Industrieanlagen GmbH, Germany

[21] Appl. No.: 142,234

[22] Filed: Oct. 25, 1993

[30] Foreign Application Priority Data

Oct. 26, 1992 [DE] Germany ..... 42 36 514.7

[51] Int. Cl.[6] ..... D01D 5/00; D01D 5/12; B29C 55/00

[52] U.S. Cl. ..... 425/66; 264/210.1; 264/211.15; 264/342 RE; 425/72.2

[58] Field of Search ..... 19/299; 264/176.1, 210.8, 264/518, 555, 168, 342 RE, 210.1, 211.15; 28/103, 101; 239/265.17; 65/463, 462, 458, 454, 465, 524; 425/66, 72.2

[56] References Cited

U.S. PATENT DOCUMENTS

| | | | |
|---|---|---|---|
| 2,433,000 | 9/1943 | Manning | 264/DIG. 75 |
| 3,460,731 | 8/1969 | McCardell Troth, Jr. | 19/299 |
| 3,929,542 | 12/1975 | Gehrig et al. | 264/210.8 |
| 4,064,605 | 12/1977 | Akiyama et al. | 19/299 |
| 4,340,563 | 7/1982 | Appel et al. | 19/299 |
| 4,731,218 | 3/1988 | Damhorst et al. | 264/210.8 |
| 4,753,698 | 6/1988 | Hartmann et al. | 19/299 |
| 4,820,459 | 4/1989 | Reifenhäuser | 264/210.8 |
| 5,045,271 | 9/1991 | Mente et al. | 264/210.8 |
| 5,242,632 | 9/1993 | Mende | 264/518 |
| 5,246,653 | 9/1993 | Horres | 264/518 |

FOREIGN PATENT DOCUMENTS

| | | |
|---|---|---|
| 1965054 | 12/1969 | Germany . |
| 3401639 | 1/1984 | Germany . |

OTHER PUBLICATIONS

Karl-August Reif, et al., Entwicklung Eines Elementarfadenvliesstoffes, 1973, pp. 82–85.

*Primary Examiner*—Jay H. Woo
*Assistant Examiner*—John Robert Abel
*Attorney, Agent, or Firm*—Basile and Hanlon

[57] ABSTRACT

An apparatus for delivering and depositing groups of continuous threads or filaments, which are conveyed by means of a gas flow and which are introduced substantially parallel into a passage having a corresponding cross-section is proposed, the gas flow accompanying the threads upon entering the upper part of the passage is accelerated to high speed and is then decelerated and the threads are deposited on a moving depositing surface. The gas flow delivering the threads flows at high speed through the passage preferably provided with parallel walls and then is decelerated by the suction of part of the gas in the lower passage area laterally through openings in the passage walls.

14 Claims, 2 Drawing Sheets

24
23a
23b
23a
23b
5
17a
10
17b
12
11
13
13
17c
14b
14a
26
17d
25a
25b
17e
16
19
15
20
22
21b
21c
21a
8
18

APPARATUS FOR DELIVERING AND DEPOSITING CONTINUOUS FILAMENTS BY MEANS OF AERODYNAMIC FORCES

FIELD OF THE INVENTION

The invention relates to a method and an apparatus for delivering and depositing groups of continuous filaments or threads.

BACKGROUND OF THE INVENTION

Continuous filaments or threads are conveyed or delivered in widespread manner e.g. during the manufacture of spunbonded material or webs, in which filaments are drawn by means of air streams from a spinneret and directly deposited to form a web. Numerous methods are known for the production of such spunbonded webs, which differ as to whether the filament bundles are spun from circular spinnerets or the thread or yarn sheets are spun from rectangular spinnerets. They also differ with regard to the production of air streams, their guidance, and generally simultaneous use for depositing the filaments on a collecting belt, so-called web formation.

It is known to spin thread or filament groups from longitudinal or rectangular spinnerets and to supply them in full width to the collecting belt. Filaments combined into bundles have the disadvantage compared therewith that they generally have to be spread out again after the pull-off device, usually a circular injector passage, in order to bring about a uniform depositing of the filaments.

In the production of the air streams drawing the filaments, in accordance with the aforementioned injector passages, such passages are also known for thread or filament sheets. In a rectangular passage, which in its upper part has slots on two facing longitudinal sides, air is forced through the slots and in exceptional cases a different gas; and it flows downward through the passage (German patent 19 65 054). As a function of the slot configuration and the pressure conditions, a specific part of the surrounding atmosphere, usually air, is also sucked in at the top into the passage. The filaments also enter the passage at the top, the secondary air inflow towards the passage proving advantageous for threading purposes. These slotted passages suffer from the disadvantage of requiring a high manufacturing precision, because the slot width are generally less than 1 mm. Additionally, the slotted passages undergo modifications over a period of time due to dirtying or damage, e.g. when removing the dirt. As a result of the adhesion of dirt and of notches in the sensitive slots, which are expensive to manufacture, there are speed differences in the air flowing over the passage width. This leads to a lack of uniformity in the conveyed thread or yarn sheet, so that areas of higher speed guide the threads or yarns to an increased extent, because once a thread is introduced there, it cannot pass again into lower speed areas unless by means of an externally forced lateral movement.

Another method consists of producing the flow by suction instead of forcing the flow in (Textilechnik, 23, 1973, pp. 82–87). Suction takes place below a collecting belt. The filaments drop freely by gravity into a hopper above the belt and are drawn there by the suction flow.

Yet another possible method is to completely encapsulate the space between the spinneret and the passage, and to force the air in laterally from an appropriate distance from the passage above the same, thereby avoiding the described disadvantages of the slot (U.S. Pat. No. 4,340,563). The drawing off passage then comprises a narrowed part of the space encapsulated under an overpressure in the form of two closely facing walls, closed by end walls, which can be parallel to one another, can cross-sectionally widen (diffuser), or can narrow and then widen (venturi).

Another possibility for producing and guiding the airflows drawing or pulling the filaments consists of encapsulating the space between the lower edge of the drawing off passage (or the narrowed part of the above-described encapsulated space functioning as such) and the depositing surface from the surrounding atmosphere and performing a suction process below the depositing surface (German patent 34 01 639). This requires sliding or rubbing seals between the passage end and the depositing surface and between the depositing surface and the suction lines below it. The upper part can also be encapsulated, and in a planned manner, contain air for cooling the threads and for supply to the passage. The area between the spinneret and the passage can also remain open to the atmosphere.

The described apparatus and methods for the production of spunbonded webs admittedly do not have the disadvantage of the time-varying slot geometry, but suffer from a limitation towards higher speed levels. High air speeds are required in order to bring about an optimum high molecular orientation of the filaments by deformation below the spinneret up to the solidification thereof. This is particularly the case with polyester threads, whereas in the case of polypropylene air drawing alone does not lead to high strength and limited elongations, as permitted by polycondensates, which are not required in most uses in the hygienic and medical fields. In the case of polypropylene geotextiles, higher strengths than hitherto are desired and all that remains is additional mechanical stretching, where once again air streams can perform the web formation. Higher thread speeds are also desired in connection with increasing the throughput and improving the economics of the method. However, there are limits thereto in web formation. The higher the air speed, the greater the turbulence between the drawing off passage and the collecting belt. In addition, ambient air is sucked in through the free jets below the drawing off passage. There is an increased air exchange prejudicial to the overall method and further turbulence is produced by the mixing action. In addition, the high degree of delay of the flow leaving the passage on the way to the collecting surface resulting from stagnation leads to a high irregular flow level, partly with a back-flow and an increased turbulence of the threads from the depositing surface. Apart from the increased energy costs, turbulence, in particular, leads to non-uniform thread distribution through the formation of bundles and strands in the subsequent web.

The widening of the air passage or duct following its narrowest region, where the highest air speeds prevail, exerting the highest forces on the threads, can bring about a diffuser which also causes serious problems. Such delayed flows, particularly following onto an upstream flow in the narrow part of the passage do not permit a strong delay through the boundary layers formed there without the flow breaking away. Such breaking away or detachment effects produce turbulence and this in turn leads to the agglomeration of the filaments so as to form strands and bundles. In addition, such detachments are generally not continuous flows, which then leads to a non-uniform thread distribution in the web.

It is particularly difficult to achieve a detachment-free flow in a planar diffuser, because these disturbances emanate from the end wall boundary layers and there is frequently a one-sided detachment on the longitudinal faces with an oblique flow profile and therefore a non-uniform distribution of the threads over the passage. In the case of circular diffuser passages the conditions are somewhat better, but here again only a limited widening can be achieved and there is a maximum 7° widening angle.

SUMMARY OF THE INVENTION

The purpose of the invention is to provide a method and an apparatus with which groups of continuous threads of filaments or substantially continuous filaments can be drawn at high speed by air streams, which can in general terms also be gas or vapour streams and can uniformly be deposited on a depositing surface without thread bundling or twisting.

According to the invention this problem is solved by the characterizing features of the method and apparatus claims in conjunction with the features of the preamble.

Due to the fact that air is sucked through a passage from below the thread depositing surface, the air entering at the top into the passage in the substantially rectangular cross-section, requires a high speed between the preferably parallel side walls in the upper area of the passage. Subsequently, the air undergoes suction by means of lateral openings in the passage walls to a specific residual flow necessary for supplying the filaments to the depositing surface. Therefore, the threads can be uniformly deposited without any thread bundle formation. In the upper part of the passage, i.e. the drawing part, a very uniform flow is obtained, because the air is sucked from the undisturbed environment, comparable with the front part of an open wind tunnel housing the model to be tested. In this area the passage has a high drawing action on the filaments, but through the lateral suction there are no longer high air speeds during the laying or formation process. There are also no laterally acting secondary flows, because the entire drawing and layering area up to the depositing surface is encapsulated from the environment.

The measures given in the subclaims permit advantageous further developments and improvements. The sealing of the continuously moved depositing surface, no matter whether it is in the form of a perforated belt or a drum, with respect to the passage and the suction chamber below the depositing surface is created in a known manner by moving rolls, sliding or concomitantly moved surfaces or brushes, as well as by labyrinth seals, which contain barrier gas flows. In order to reduce the sucked in air quantity and therefore the energy costs, the passage can be relatively narrow, e.g. 2 to 4 mm, because only the speed level is important for producing the force action on the filaments. Apart from the air quantity necessary for distortion/stretching, the passage width is also determined by the quantity and thickness of the filaments and an operational safety supplement in order to avoid striking against the wall. If narrow passage widths are possible, then also in the case of high speeds in the parallel drawing part of the passage, laminar flows are possible with the advantage of a lower reciprocating movement of the filaments compared with a turbulent flow. The filaments then pass in a quieter manner along substantially parallel paths with spacings predetermined by the spinneret holes while transversely to the spinneret's longitudinal axis the filaments are brought together to the passage width from the generally greater spinneret plate width in transverse direction.

The filaments pass in a molten manner out of the spinneret, and as known in the art are subject to a quench air action and pass in solidified form into the passage. The area below the passage is preferably not sealed off from the ambient air, so that the quench air is only partially sucked by the passage, but spinning fumes which could dirty the passage are blown out laterally further upwards.

In order to avoid the known difficulties with respect to the diffuser, suction takes place in a parallel or substantially parallel lower passage part, where porous surfaces or individual holes are provided. It has surprisingly been found that large air quantities can be laterally sucked out of the passage without influencing the travel of the filament sheet. The speed of the air flowing laterally through the surfaces must be below the speed of the air in the downward direction through the passage. It is then possible without other boundary layers influencing, such as by suction or blowing in for pulse supply in aerodynamics and in diffuser flows e.g. from German patent 38 07 420, to reduce the speed by removing material. The situation is different with the diffuser where, while maintaining the material, the speed is reduced by increasing the cross-section.

The laterally sucked in air can be sucked from the same blower which is used for suction action below the depositing surface. It can also be provided by a separate blower or other suction mechanisms. The sucked in air can be supplied again for air compensation purposes by the suction mechanisms to the spinning area if this is not ensured in some other way.

When sufficient air has been laterally removed for the filaments to be adequately linearly supplied to the depositing surface, at the end of the parallel part, the passage can widen to form a depositing chamber. In such, an impact diffuser can be provided with baffles. Therefore, it is possible to deposit the filaments at much lower air speeds than in the drawing part to form a uniform web. A first widening can be provided in the lower area of the passage, followed by the widening in the depositing chamber. The suction chambers, laterally on the passage wall, can communicate with the laying area. The sucked in air is again supplied wholly or partly to the main circuit, but generally without acting on the thread sheet.

BRIEF DESCRIPTION OF THE DRAWINGS

An embodiment of the invention is described in greater detail hereinafter relative to the attached drawings, wherein.

DESCRIPTION OF THE PREFERRED EMBODIMENT

Figure 1:
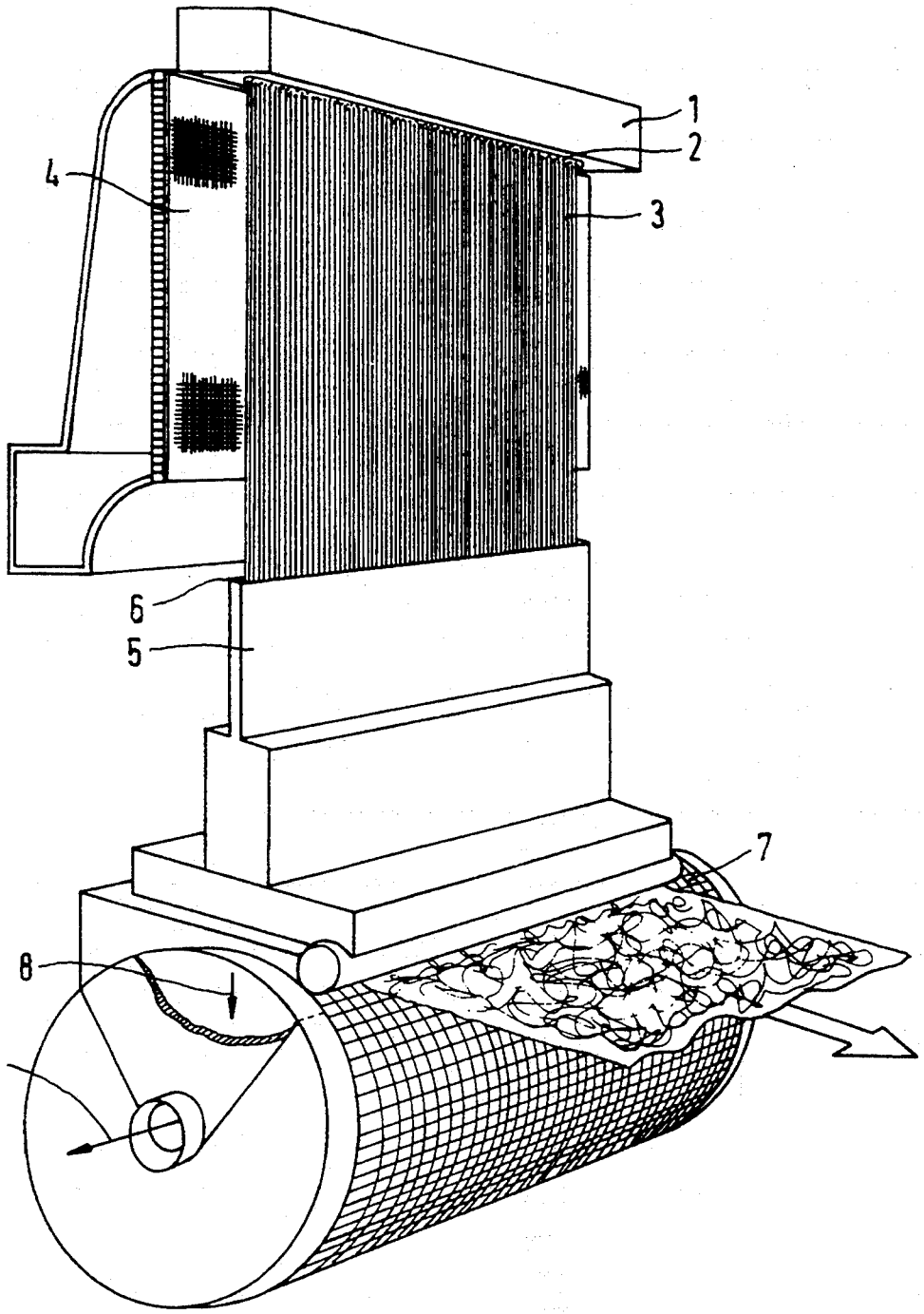
FIG. 1 A perspective view of the apparatus for delivering and subsequently delaying the groups of continuous filaments according to an embodiment of the invention in the production of spun bonded webs directly from the spinneret.
Figure 2:
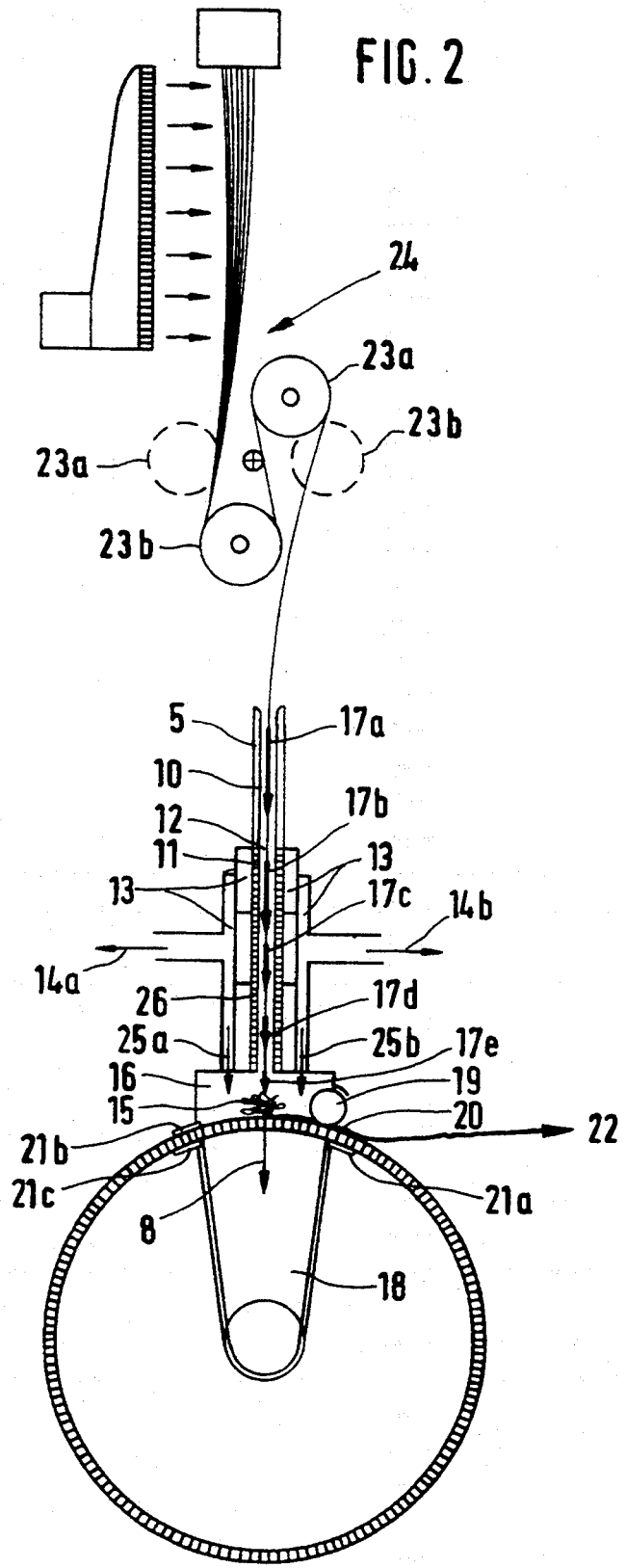
FIG. 2 A section through the apparatus according to FIG. 1 showing a mechanical force transfer to the filaments by friction action and with the aid or rotary rollers.

As shown in FIGS. 1 and 2 filaments of threads 3 in the form of a group or sheet pass from a rectangular spinneret 1 through rows of parallel holes 2 and by means of a lateral quench air device 4 are cooled by generally temperature and moisture-conditioned air. They pass into a drawing off passage 5 and namely into the upper rectangular opening 6 thereof. In the passage 5 is produced a vacuum, which is produced by a not shown suction device (blower, compressor or jet pump) illustrated by the arrows 8 and 9, positioned below the depositing surface and which in the present embodiment is constituted by a perforated drum 7. The ambient air is greatly accelerated by the vacuum upon entering the drawing off passage 5 and then flows at high speed through an upper part of the passage 5, called the drawing part 10, which is constructed as a parallel passage and passes into a lower, parallel area. The walls of the area 11 have openings 26, which issue into chambers 13. The air from the free passage cross-section 12 is sucked via the openings 26 and chambers 13 in accordance with the arrows 14*a* and 14*b* by a suction device (not shown). Part or all of the lateral suction from the passage area 11 can also be carried out by the suction mechanism whose action is illustrated by the arrows 8 and 9.

The openings 26 in the passage walls are in the form of round holes, but can also have a different cross-section. In addition, it is possible to use a porous material for the passage wall in the lower area 11 which permits the passage of certain air quantities.

The chambers 13 can comprise different segments, which are superimposed over the height of the lower area 11. The chambers 13 are either used for rendering the suction action uniform or for forming different, laterally sucked in partial flows. To the extent that lateral air is sucked in, the speed of the main flow in the drawing off passage 5 is reduced. The speed of the air flow part sucked in laterally through the openings must be below the main flow speed at the suction point.

The lower passage area 11 issues into the laying area 16, in that there is a sudden cross-sectional widening of the parallel passage with the free-cross-section 12. As illustrated by the arrows 17*a*, 17*b*, 17*c*, 17*d*, 17*e*, the speed of the air is greatly reduced by the lateral suction action, and the filaments are deposited in the laying area 16 at a much lower speed than in the upper drawing part 10. This takes place on the depositing surface 15. According to arrow 17*e*, in limited cases the air speed at the end of the passage 5 can drop to and even below the filament speed. The air speed is then further decreased and the filaments accumulate in curved paths and intertwine with one another until they end in the web deposit. This initiation of intertwining of the filaments to form a random web can even begin in the lower passage area 11, if the accompanying airflow is lower than the thread speed in the drawing part 10. Below the laying area 16 within the drum 7, a suction area 18 is divided off. The sealing of the vacuum laying area 16 and suction area 18 with respect to the drum 7 are diagrammatically indicated in a roller 19 at the outlet of the web 20 produced and rubbing surfaces 21*a*, 21*b*, 21*c*. The web is supplied along the arrow 22 to the further treatment, such as bonding and is then continuously wound up.

The aim of allowing very high forces to act on the filament can be improved in that above the passage 5, in known manner, stretching rolls or rollers 23*a*, 23*b* can be pivoted into the filament sheet drawn from the passage 5. By friction action on the wrapped round rollers, corresponding to the operation of a rope transmission, the drawing off action on the threads is increased by the frictional forces on the rollers 23*a*, 23*b* and there is a combined mechanical-aerodynamic stretching of the threads. In place of a roller pair, several rollers could be superimposed, advantageously in such a way that the rollers 23*a*, 23*b* are initially horizontally juxtaposed at the same height (in broken line form in FIG. 2), so that the filament sheet on passage from above passes between the two rollers and can be supplied to the depositing surface 15. The roller pair is then rotated by up to roughly 270° and the drive of the rollers with a substantially identical speed (the second roller can have a somewhat higher circumferential speed by the drive speed or by a larger diameter) additionally exerts a force action on the filaments in order to bring about greater stretching in the lower filament formation area 24.

The apparatus and method for producing the spunbonded webs with said apparatus is not restricted to continuous filaments. It is also possible to supply to the passage through the accompanying air streams, filaments having a finite length and in the same way exert a drawing action on portions of the filaments. Such processes are known in connection with melt-blown threads and hot airflows pass out alongside the melting openings. The threads can be infinitely long or every so often torn off to form a range of irregularly long fibers.

The advantages of the apparatus according to the invention are particularly apparent when producing spunbonded webs, as shown in FIGS. 1 and 2. The suction of the undisturbed air into the passage 5 from the area below the cooling zone gives a very uniform flow in the upper passage area or drawing part 10. With a good sealing between the laying area 16 and the depositing surface 15 the air speed in the drawing part 10 can be 10,000 m/min and higher and can theoretically extend up to the speed of sound of approximately of 18,000 m/min, but in practice is somewhat lower. As a result of the lateral suction through the openings 26 at discrete points, the parallel path of the threads is not, or not significantly disturbed. A slight constriction of the thread bundle is due to the boundary layers building up at the faces of the passage 5, which can be reduced or completely eliminated by a known boundary layer influencing. This can be brought about by blowing in, i.e. the supply of pulse energy to the boundary layers, as well as by suction in accordance with the prior art. The laying of the filaments and the intertwining thereof to a random web takes place at much lower speeds than in the drawing part 10, so that strong turbulence is prevented, which would lead to thread bundles and twists causing strands in the web. Through a very uniform and well separated depositing of threads, the aim is to bring about an optimum copacity of the surface, so as to best utilize the spinning raw material.

Apart from these advantages, which can be achieved in a compact plant with small overall dimensions, the energy costs are lower than in the prior art spunbonded web production methods, in that there is no need to move secondary air flows which are prejudicial to the air circulation and do not help thread stretching and web laying. The laying of the filaments can be partly coupled with the suction action on the lower lateral faces of the passage, in that the suction action below the depositing surface 15 directly communicates with the chambers 13, illustrated by the arrows 25*a* and 25b. However, the zone between the spinneret 1 and the drawing off passage 15 is open for cleaning the spinneret 1. It is also possible to have an additional mechanical stretching means there, which also leads to operational advantages. The spinneret and the following units, as shown in FIG. 1, thus extend over the entire width of the web produced. They need not be strictly at right angles to the web reception direction, but can also be at certain angles thereto. With the additional mechanical stretching the rollers 23*a* and 23*b* can be mounted at both sides with a desired large web width. This is not the case when stretching with one-sided mounted godets filament bundles or narrow filament strips or sheets, wherein the rollers for the stretching are rotating at different speeds. It is also possible to have pivot-in rolls or rollers with approximately the same speed, which help in drawing the thread in the manner of a rope transmission, in addition to the aerodynamic frictional forces in the passage.

In order to obtain higher molecular orientation of the filaments, the filaments can be heated from the outside again, e.g. by means of radiant heaters following distortion from the melt, cooling and solidification by a heat supply. With high thread speeds, a further stretching then takes place in the form of a neck with a great molecule orientation increase due to this process. Due to the diameter reduction the thread rapidly cools and the high oriented state is frozen in. Strength increases and expansion decreases, so that high-quality threads are obtained. The correct reheating position can easily be established by experiments. The interior of the thread must not have excessively cooled so that distortion with neck is even easier.

It is conceivable to set the parallel passage walls in the drawing and suction parts in a slightly inclined manner, i.e. in diffuser or nozzle-like manner. This can lead to advantages in special cases. However, parallel passage walls, with sudden widenings, are most suitable for the purposes of the invention, namely the guidance of the filaments on parallel paths at high speeds of the accompanying air streams in the drawing part 10 and the increasingly slowed down air speeds into the depositing surface.

With respect to spunbonded web production the invention is illustrated by the following examples.

EXAMPLE 1

Spin filaments or threads from a melt of polyethylene terephthalate (PET) having an intrinsic viscosity of 0.64, measured by dissolving in phenol/tetrafluoroethane 1:1 ration at 20° C. in a known manner having a melting temperature of 260° C. passed from a spinneret with holes having a diameter of 0.3 mm arranged in parallel rows. The throughput per melt hole was 0.55 g/min. In all, 180 holes were uniformly distributed over a spinneret width of 220 mm. Below the spinneret was a vertical, planar surface, from which passed air at 25° C. for cooling the threads and at a speed transversely thereto of 0.9 m/s. The length of the cooling surface (quench duct height) was 800 mm. At a distance of approximately 200 mm was provided the inlet cross-section of the drawing off passage, whose width was 4 mm and projected by 8 mm to either side of the thread sheet width. The length of the parallel drawing part was 420 mm and below it began the suction part, i.e. the lower area of the passage, with a total length of 250 mm. Lateral suction took place through individual holes in the passage wall with different diameters between 2 and 8 mm. Use was also made of porous sintered metal surfaces, but this did not alter the process result. Through the partly transparent passage walls it was possible to observe that the filaments moved downwards in substantially parallel paths over the entire drawing and suction part of the passage.

Suction was set in different ways from an air speed roughly twice as high as the thread speed at the transition from the parallel suction part into the sudden widening of the laying area to speeds in the latter slightly below the thread speed. In the latter case the threads started to move in sinuous paths, which then greatly increased in the sudden widening. The vacuum in the laying area 16 was 1050 mm water column, corresponding to approximately 105 mbar with respect to atmosphere. The laying area 16 was sealed with respect to a rotating drum by means of sealing elements, as described in detail. The thread sheet constriction in the lower part was only a few mm so that a web with a width of approximately 200 mm, compared with the original thread sheet with the 200 mm, formed with a slightly reinforced outer edge. The threads had an average size of 1.7 dtex corresponding to roughly 17 $\mu$m, the strength was 2.6 cN/dtex, the elongation and the strength at the break of the threads in the tear test was 107% and the shrinkage in boiling water was below 3%. All the values were determined in accordance with the relevant DIN standards.

Webs in the range 6 to 80 g/m$^2$ were obtained through a correspondingly modified circumferential speed of the drum as the depositing surface. The drum consisted of a perforated surface with gauzes placed thereon. The weight per unit area distribution had a coefficient of variation below 8%, and down to 4% with heavier webs.

EXAMPLE 2

Polypropylene (PP) with a melt flow index (MFI) of 28 g/10 min measured by DIN 53735, at a temperature of 230° C. and a load in the measuring flask of 2.16 kg, was spun through the same spinneret as in example 1 at 260° C. and with a throughput per spinning hole of 0.5 g/cm. This test aimed at the production of lightweight webs for hygiene or medical uses. The vacuum in the depositing area 16 was 850 mm water column, roughly corresponding to 85 mbar.

The threads had an average size of 16 dtex, roughly corresponding to 18 $\mu$m. The webs produced were in the range 6 to 35 g/m$^2$ and had a coefficient of variation of the weight per unit area distribution of below 10 or below 6%. After depositing the threads, the web was raised from the drum and supplied to a calendar, in which the web was bonded in punctiform manner between a heated roller provided with serrations (frustum-shaped) and was subsequently wound up.

The apparatus according to the invention has been described in connection with the production of spunbonded fabrics. A further field of use is the delivery of threads and stitch-bonded materials, the depositing surface speed being roughly the same as the filament speed. A further use is the delivery of threads with air at high speed and the separation of the air, this not being simultaneously linked with high turbulence production.

We claim:

1. An apparatus for delivering and depositing groups of continuous and substantially parallel threads comprising an elongated passage for guiding the threads, a means for producing a gas flow for delivering the threads into the passage, and a laying device having a depositing surface, the passage passing via the depositing surface into a laying area of increased cross-section, wherein the passage has an upper area and a lower area, the lower area located adjacent the laying area and being provided with a passage wall having openings through which part of the gas flow is sucked from the passage to decelerate the gas flow in the passage.

2. The apparatus according to claim 1, wherein the passage has substantially parallel walls.

3. The apparatus according to claim 1, wherein the passage and the laying area are directly interconnected and sealed from the outside, wherein at the transition between the passage and the laying area there is a sudden cross-sectional widening.

4. The apparatus according to claim 1, wherein the device for producing a gas flow for delivering the threads is constructed as a suction mechanism located in a suction area below the depositing surface, the suction area below the depositing surface, the laying area and the passage being sealed with respect to the environment forming a common vacuum area.

5. The apparatus according to claim 1, wherein the openings in the passage walls are uniformly distributed over the lower area of the passage.

6. The apparatus according to claim 1, wherein the openings are constructed as holes provided in the passage walls and having one of the same and different cross-sections.

7. The apparatus according to claim 1, wherein the passage wall lower area is made from a porous material.

8. The apparatus according to claim 1, wherein the lower area of the passage is surrounded by chambers, which are linked with the suction mechanism.

9. The apparatus according to claim 8, wherein the chambers have different segments over the height of the lower area of the passage and which are constructed for rendering uniform the suction and for forming different partial flows of the part of the gas flow entering the passage that is sucked in via the lower area.

10. The apparatus according to claim 9, wherein the chambers are linked with the laying area.

11. The apparatus according to claim 1 for producing spunbonded webs, further comprising at least one spinneret with a rectangular cross-section for spinning the parallel thread sheet and a blowing device located under the spinneret for the lateral quench blowing of the threads leaving the spinneret.

12. The apparatus according to claim 11, further comprising a roller arrangement between the spinneret and the passage for mechanical stretching.

13. The apparatus according to claim 3 wherein the lower area has another sudden cross-section widening.

14. An apparatus for delivering and depositing groups of continuous threads comprising:

a pair of essentially parallel walls forming an elongated passage therebetween, having a predetermined cross-area;

a means for producing a gas flow for delivering the threads into the passage;

a laying area having a depositing surface for receiving the threads; and a means for laterally removing a portion of the gas from the passage to decelerate the gas flow in the passage before said gas and threads arrive in the laying area.

* * * * *

UNITED STATES PATENT AND TRADEMARK OFFICE

CERTIFICATE OF CORRECTION

PATENT NO. : 5,439,364

DATED : August 8, 1995

INVENTOR(S) : Juder Gerking, Friedrich Weger

It is certified that error appears in the above-indentified patent and that said Letters Patent is hereby corrected as shown below:

Column 1, line 5, before "invention relates" insert --present--.

Column 1, line 10, before "widespread manner" insert --a--.

Column 1, line 19, after "circular spinnerets" insert --,--.

Column 1, line 48, delete "width" and insert --widths--.

Column 2, line 18, after "surface", first occurance, insert --,--.

Column 2, line 33, after "polypropylene" insert --,--.

Column 4. line 6, after "width in" insert --the--.

Column 6, line 57, delete "copacity" and insert --opacity--.

Column 7, line 3, after "passage" delete "15" and insert --5--.

Column 7, line 13, delete "one-sided" and insert --one-side--.

Column 7, line 30, delete "expansion" and insert --elongation--.

Column 7, line 52, delete "ration" and insert --ratio--.

Column 8, line 48, delete "16" and insert --1.6--.

Signed and Sealed this

Seventh Day of May, 1996

Bruce Lehman

*Attest:*

BRUCE LEHMAN

*Attesting Officer*

*Commissioner of Patents and Trademarks*